US006193243B1

(12) United States Patent
Johannes Meester et al.

(10) Patent No.: US 6,193,243 B1
(45) Date of Patent: Feb. 27, 2001

(54) CLAP SKATE

(75) Inventors: Frank Arend Johannes Meester; Hans Meester, both of Leiden (NL)

(73) Assignee: Viking Schaatsenfabrick B.V., Weesp (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/166,752

(22) Filed: Oct. 5, 1998

(30) Foreign Application Priority Data

Oct. 8, 1997 (NL) ..... 1007230

(51) Int. Cl.[7] ..... A63C 1/00

(52) U.S. Cl. ..... 280/11.22; 280/11.12; 280/11.3; 280/11.27

(58) Field of Search ..... 280/11.14, 11.15, 280/11.27, 11.28, 11.22, 11.23, 11.24, 11.19, 11.31, 623, 11.224

(56) References Cited

U.S. PATENT DOCUMENTS

| | | | | |
|---|---|---|---|---|
| 829,900 | * | 8/1906 | Shelmire | 280/11.14 |
| 940,108 | * | 11/1909 | Yates | 280/11.2 |
| 5,503,413 | * | 4/1996 | Belogour | 280/11.22 |
| 5,704,621 | * | 1/1998 | Lazarevich et al. | 280/11.28 |
| 5,961,131 | * | 10/1999 | Hilgarth | 280/11.22 |
| 6,007,075 | * | 12/1999 | Shum | 280/11.12 |

FOREIGN PATENT DOCUMENTS

| | | |
|---|---|---|
| 0 381 092 B1 | 4/1993 | (EP) . |
| 0 559 179 A1 | 9/1993 | (EP) . |
| 0 778 058 A2 | 11/1996 | (EP) . |
| WO 97/18019 | 5/1997 | (WO) . |

* cited by examiner

*Primary Examiner*—Michael Mar
*Assistant Examiner*—Hau Phan
(74) *Attorney, Agent, or Firm*—Foley, Hoag & Eliot LLP

(57) ABSTRACT

A clap skate include a forefoot support which is adapted for fastening the sole portion of said skating shoe thereon. The forefoot support is pivotally connected to the front part of a skate frame about a transverse pivot pin, so as to allow said forefoot support with the skating shoe thereon to tilt about the pivot pin forwardly from a normal position, so that the skating shoe is lifted with its heel portion from the rear portion of the skate frame. The pivot pin is held between two bracket flanges extending upwardly from the front part of the skate frame. A spring mechanism tending to cause the forefoot support to return into the normal position comprises a U-shaped spring wire, the cross portion of which engages the upper face of the forefoot support and the legs of which are provided with a helically wound portion. The helically wound portions are each positioned around the pivot pin in an intermediary space between a flange and one lateral end of said forefoot support.

4 Claims, 3 Drawing Sheets

CLAP SKATE

FIELD OF THE INVENTION

The invention relates to skates of the type, with which the skater's foot may tilt forwardly relative to the skate frame while the latter is holding contact with the "ice" surface, and with which the skate frame returns to its normal or starting position relative to the skater's foot as soon as it is taken off the (ice) surface. The term "clap skate" is meant to cover both ice skates and inline roller skates (also called "skeelers"). Both of this clap skate versions are known. Especially the ice skate version has become very popular.

BACKGROUND OF THE INVENTION

In the type of skate to which the invention relates, the skate frame has a forefoot support and a heel support. The forefoot support is pivotally connected to the frame about a transverse pivot pin. A forward tilting movement of the skater's foot relative to the skate frame, while the latter is in contact with the (ice) surface, is taking place against the action of a spring means. Thus said spring means tends to force the skate frame to return to its normal position relative to the skater's foot (i.e. with the heel of the foot resting on the fixed heel support) as soon as the skate frame is taken off the (ice) surface at the end of the skater's push.

Thus the pivot connection between the frame and the forefoot support allows the skater's foot to turn away from the skate frame and thereby stretch completely during the skater's push being applied onto the (ice) surface. As a result of this the skater's push is optimalized.

The reinstatement of the contact between the fixed heel support and the heel at the end of the return movement is accompanied by a blow or "clap".

Depending on the angle, through which the skate frame has turned away during the push phase, the returning movement will take place with more or less force and consequently with a more or less powerful clap.

OBJECT AND SUMMARY OF THE INVENTION

It is a principle object of the invention to provide an effective and reliable spring means for effecting the return movement of the skate frame. A further object of the invention is to provide a compact spring means which is adapted to be mounted at a location where it is effectively guarded against access from the outside.

Further objects and advantages of the invention will be hereinafter further explained by way of example with reference to the accompanying drawing.

DESCRIPTION OF THE PREFERRED EMBODIMENT

Figure 1:
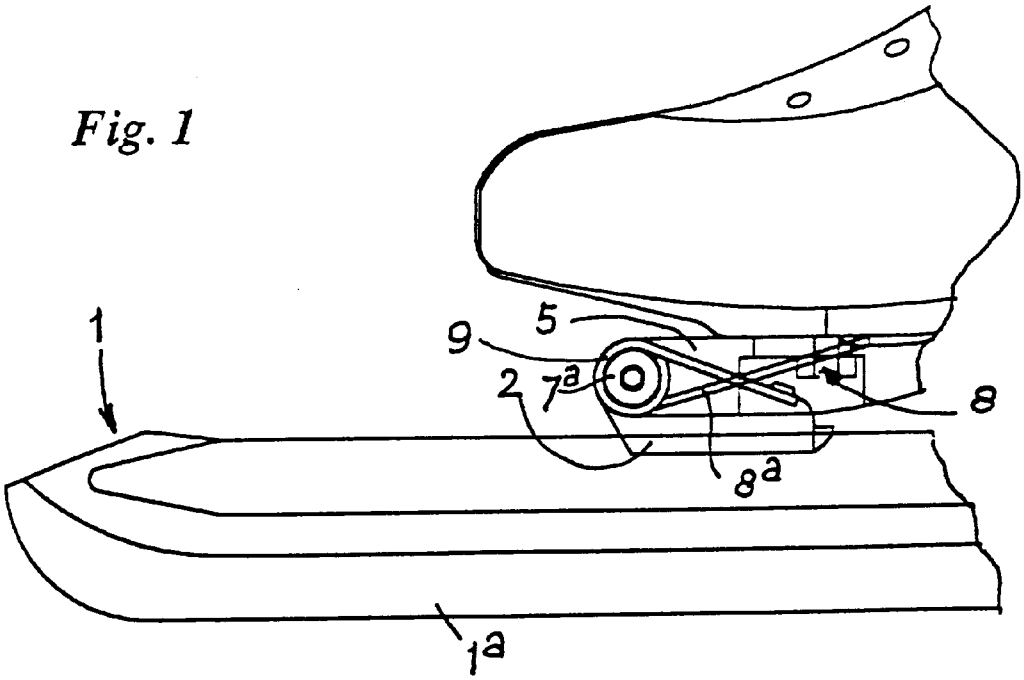
FIG. 1 is a side view of the front part of a clap skate/shoe combination, in the normal position, wherein the pivot connection between the frame of the skate and the forefoot support is shown in cross-section.
Figure 2:
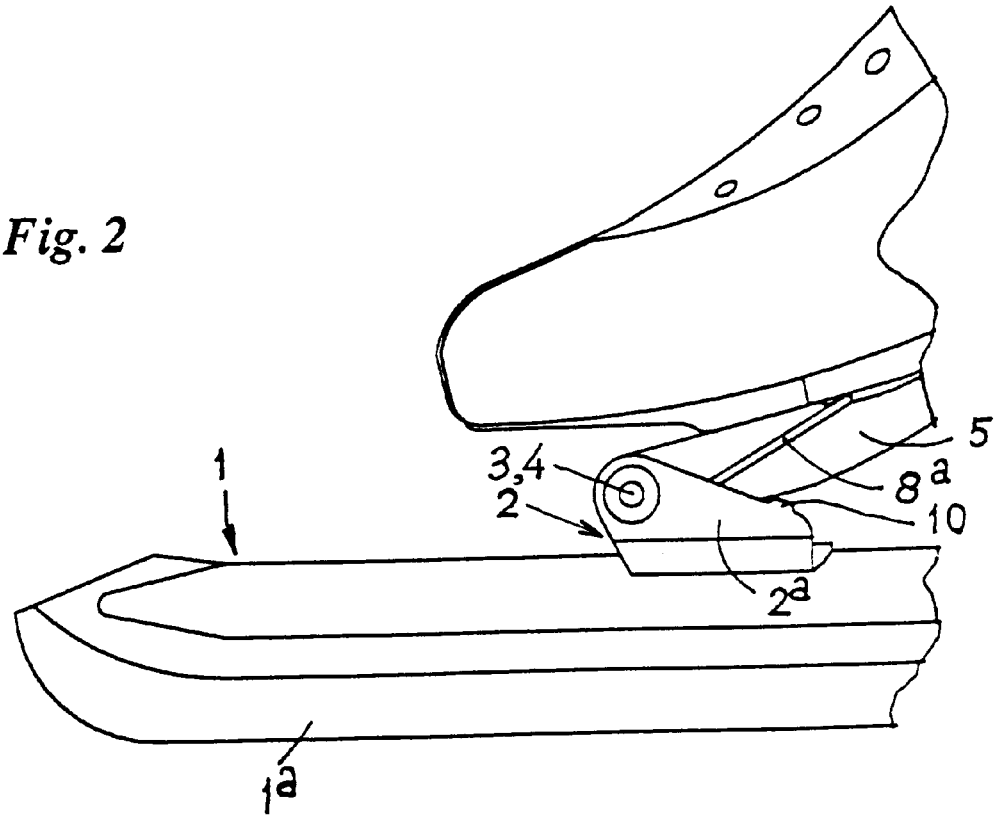
FIG. 2 is a side view of the combination of FIG. 1, but with the shoe in a forewardly tilted position relative to the frame of the skate.

With reference to FIGS. 1 and 2 1 is the front part of the tubular skate frame holding the sliding blade 1*a* of a speed skate of the "Norwegian" type.

Figure 3:
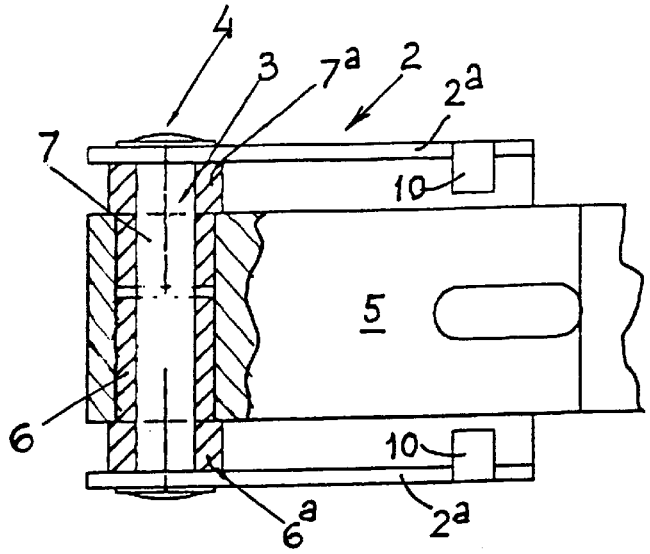
FIG. 3 is a plan view of the forefoot support upon removal of the shoe, and partially in horizontal cross-section through the pivot connection.
Figure 5:
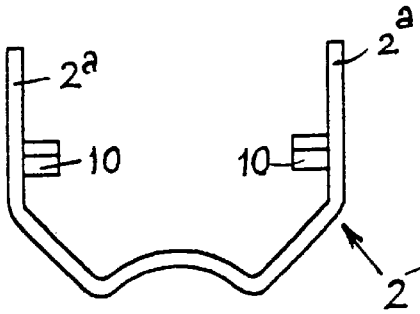
FIG. 5 is a front view of the bracket, in which the forefoot support is pivotally mounted.
Figure 4:
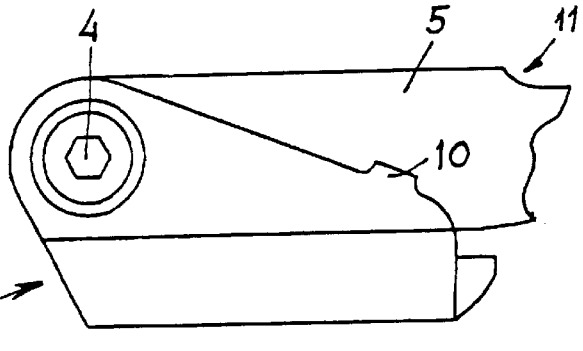
FIG. 4 is a side view of the forefoot support of FIG. 3.

A bracket 2 is fastened, e.g. by soldering, onto the frame 1 (see also FIGS. 3–5). A pivot pin 3 is fixedly, but removably connected between the two flanges 2*a* of bracket 2 by means of a fastening screw 4 extending through said pivot pin.

A forefoot support 5 adapted to be fastened to a skating shoe is rotatably mounted on said pin 3. For this 5 purpose bearing bushes 6 and 7 are mounted in a bore of the forefoot support 5. The bearing bushes 6 and 7 may be formed of brass or a suitable plastic material.

The outer ends of the bearing bushes 6 and 7 project beyond the respective ends of the forefoot support and are widened to form collars 6*a* and 7*a* respectively, which collars slidingly engage the inner side of the respective bracket flanges 2*a*.

Figure 6A:
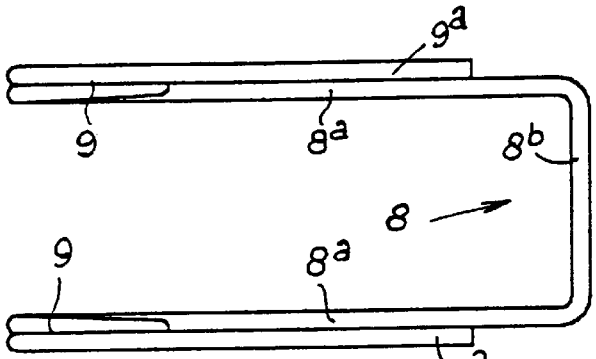
FIG. 6A is a top view of the spring shown in FIG. 1.
Figure 6B:
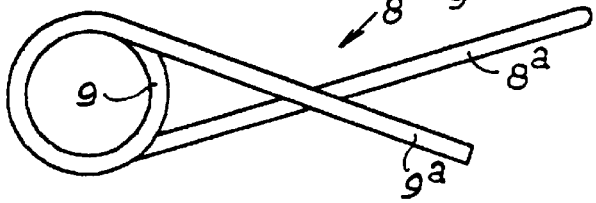
FIG. 6B is a top view of the spring shown in FIG. 6A.
Figure 6:
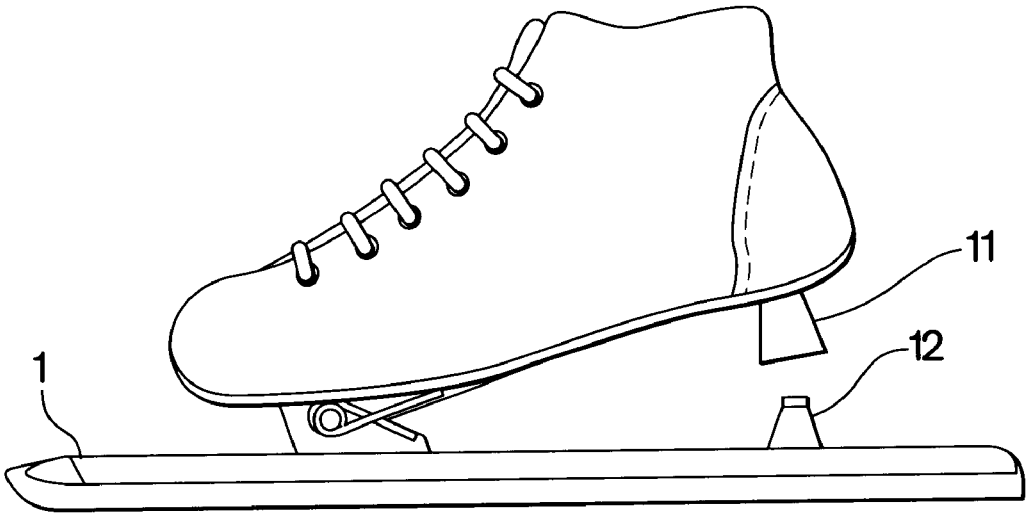
FIG. 6 is a side view of the skate of FIG. 1 shown in its entirety.

In the normal travelling position shown in FIG. 1, the heel portion 11 (as shown in FIG. 6) of the shoe is supported on a fixed heel support 12 (as shown in FIG. 6) on the rear part of the frame 1.

Due to the pivot connection described hereinabove the skating shoe fastened onto the forefoot support 5 may turn from the position shown in FIG. 1 towards the position shown in FIG. 2. This movement, which occurs particularly in the last phase of the push exerted with the skate under skating conditions, is taking place against the action of a spring 8 (see FIGS. 1 and 2). The spring 8 is constituted by an U-shaped spring wire see FIGS. 6A and 6B, the cross portion of which engages the upper face of the forefoot support 5 and the legs 8*a* of which are provided with helically wound portions 9, which are positioned about the collar portions 6*a* and 7*a* of the bearing bushes 6 and 7. The free end portions 9*a* of the spring 8 are held by prongs 10 which extend from the bracket flanges 2*a* inwardly.

As soon as the skate/shoe combination gets off the ice at the end of the push, the spring 8 causes the combination to return to the position shown in FIG. 1.

It will be appreciated that the return spring 8 described hereinabove is of a simple and compact construction. It may be mounted relatively easily, whereas it is effectively guarded against obstruction from the outside.

What is claimed and desired to be secured by Letters Patent of the United States of America is:

1. A clap skate, comprising:

a frame for holding surface contacting displacement means;

a heel support for a heel portion of a skating shoe, said heel support being fixedly mounted on a rear part of said frame;

a forefoot support for fastening a sole portion of said skating shoe thereon, said forefoot support being pivotally connected to a front part of said frame about a transverse pivot pin, so as to allow said forefoot support with the skating shoe thereon to be tilted about said pivot pin forwardly through an angle of at least 30 degree from a normal position with the forefoot support against the frame, whereby the skating shoe is lifted with its heel portion from said fixedly mounted heel support;

two bracket flanges extending upwardly from said front part of said skate frame, said flanges holding said pivot pin about which said forefoot support is pivotally connected; and a spring means tending to cause said forefoot support with the skating shoe thereon to return into said normal position, with the heel portion of the skating shoe resting on said heel support, wherein said spring means is constituted by a substantially U-shaped wire spring, the U-shaped wire spring having a cross portion which engages an upper face of the forefoot support and a pair of legs, each leg being provided with a helically wound portion, said helically wound portion being positioned around said pivot pin in intermediary spaces between said bracket flanges and lateral ends of said forefoot support, each of the legs of the U-shaped wire spring includes a free end portion which is held along an inner surface of a respective bracket flange by a projection which extends inwardly from each bracket flange such that the spring is effectively guarded against obstruction from foreign matter.

2. A clap skate according to claim 1, wherein said pivot pin extends through bearing bush means mounted in a cross-bore of the forefoot support, said bearing bush means extending beyond the lateral ends of said forefoot support for sliding engagement with the inner faces of the respective bracket flanges.

3. A clap skate according to claim 2, wherein the bearing bush means includes projecting bearing bush ends having an enlarged diameter, the helically wound spring portions being positioned around the projecting bearing bush ends.

4. A clap skate according to claim 2, wherein the legs of the wire spring extend alongside said forefoot support, which engage on the upper face of said forefoot support obliquely forwardly and downwardly to a point below said projecting bearing bush ends, and wherein the free leg end portions extend from the upper side of said projecting bearing bush ends obliquely downwardly and reawardly along corresponding downwardly sloping upper edges of said bracket flanges.

* * * * *